United States Patent [19]

Krug

[11] 4,360,983

[45] Nov. 30, 1982

[54] SNOW THROWER IMPELLER

[75] Inventor: Charles C. Krug, Saginaw, Tex.

[73] Assignee: K & S Industries, Inc., Fort Worth, Tex.

[21] Appl. No.: 197,019

[22] Filed: Oct. 15, 1980

[51] Int. Cl.[3] ..... E01H 5/00

[52] U.S. Cl. ..... 37/233; 366/312; 37/259

[58] Field of Search ..... 37/43 D, 43 R, 53; 366/309, 312, 313; 56/294; 406/71

[56] References Cited

U.S. PATENT DOCUMENTS

| | | | |
|---|---|---|---|
| 2,307,412 | 1/1943 | Lewis | 37/53 |
| 2,526,367 | 10/1950 | Kaltenbach et al. | 366/313 X |
| 2,549,043 | 4/1951 | Arthur | 37/43 D X |
| 3,021,661 | 2/1962 | Couberly | 37/43 D X |
| 3,359,661 | 12/1967 | Speiser et al. | 37/53 X |
| 3,452,460 | 7/1969 | Cope et al. | 37/43 D |
| 3,805,421 | 4/1974 | Kamlukin et al. | 37/43 D |
| 4,190,972 | 3/1980 | Berner | 37/53 X |

*Primary Examiner*—Edgar S. Burr
*Assistant Examiner*—Moshe I. Cohen
*Attorney, Agent, or Firm*—Robert A. Felsman

[57] ABSTRACT

A hand operated snow thrower has an impeller with blade mounts that allow the blades to be easily removed, yet effectively retained with the blade mount. The impeller includes a rigid rotor that is rotatably driven by the snow thrower. The rotor has three blade mounts, each blade mount having a blade supporting surface. The blade supporting surface has an inner edge and an outer edge. A retainer extends over the inner edge of the supporting surface to define a channel. A slot extends from the supporting surface rearwardly into the rotor. The flexible blade that is mounted to the impeller has a flange that is received within the slot. The blade has an inner edge that is received within the channel.

3 Claims, 3 Drawing Figures

SNOW THROWER IMPELLER

BACKGROUND OF THE INVENTION

This invention relates in general to snow removing devices, and in particular to an impeller for a powered hand operated snow thrower.

One of the smaller types of machines for removing snow from sidewalks and driveways has a housing with a rotatably driven impeller for receiving snow and discharging it through a chute. The operator pushes the snow thrower along the sidewalk or driveway with a handle.

The impeller for this type of snow thrower has several resiliently flexible blades mounted to a rotor. The blades wear from contact with the snow and debris, thus must be replaced periodically. Usually the blades are bolted to the rotor in various manners. With some devices, removing the blades is a time consuming task.

Different types of blade mounts are shown in U.S. Pat. Nos. 2,307,412; 4,190,972; and 3,359,661. A mounting for an impeller that is used in combination with an auger in a snow thrower is shown in U.S. Pat. No. 3,805,421.

SUMMARY OF THE INVENTION

The impeller of this invention has a rigid rotor that is rotatably driven by the snow thrower. The rotor has at least one blade mount, preferably three, with a blade supporting surface. The blade supporting surface faces the direction of rotation and has an inner edge and an outer edge. A retainer formed with the rotor extends over a portion of the inner edge, defining a channel. The blade mount also has a lengthwise slot that extends rearwardly from the supporting surface between the channel and the outer edge. The resiliently flexible blade has an inner edge that fits in the channel and a flange that extends rearwardly from the back of the blade for fitting into the slot. The slot and the channel secure the blade to the rotor, resisting the centrifugal and drag forces that tend to pull the blade from the rotor.

DESCRIPTION OF THE PREFERRED EMBODIMENT

Figure 1:
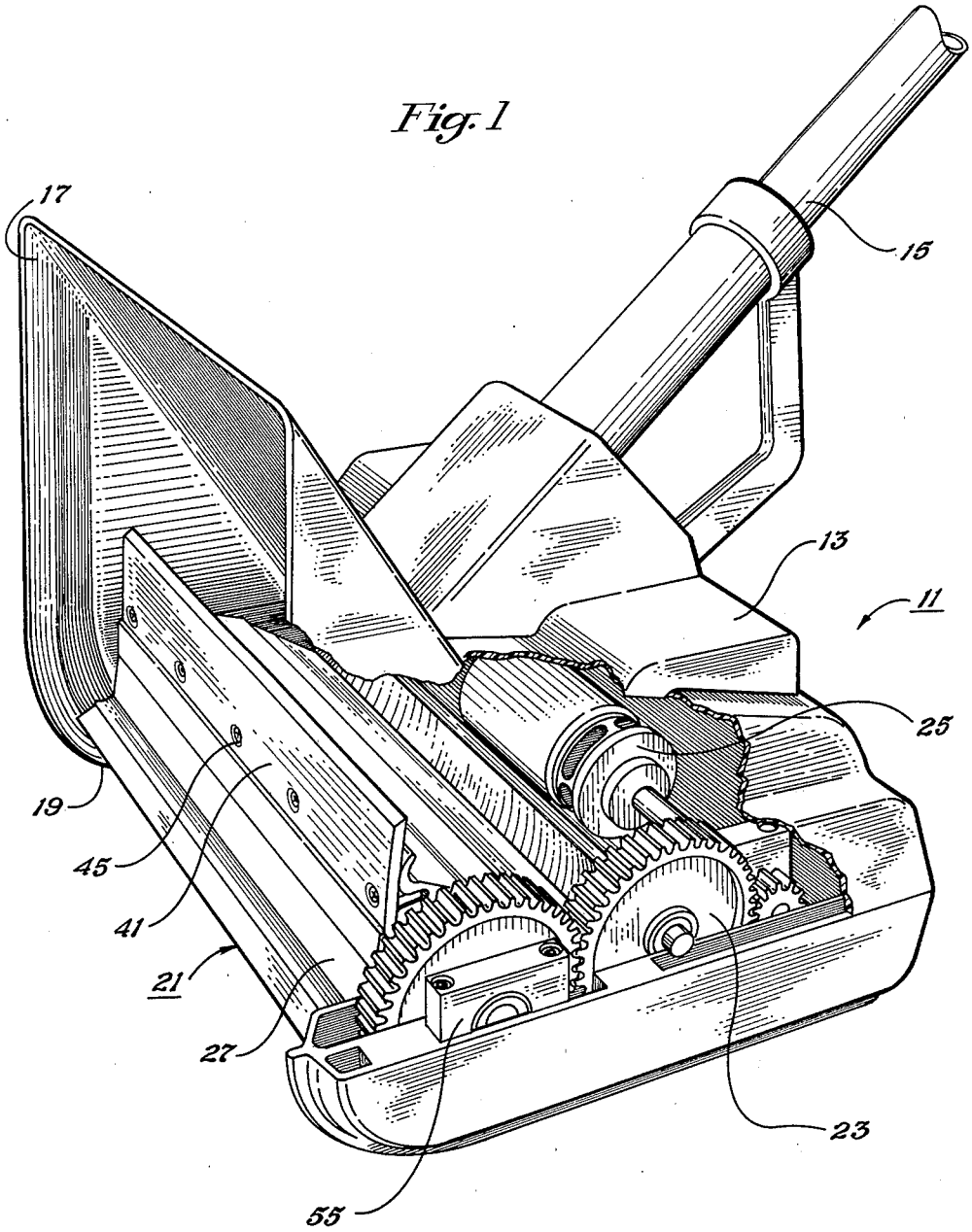
FIG. 1 is a perspective view, partially in section, of a portion of a snow thrower having an impeller constructed in accordance with this invention.

Referring to FIG. 1, a snow thrower 11 has a housing 13. A partially shown handle 15 extends upwardly. On the forward end of snow thrower 11, a chute 17 faces upwardly and outwardly. An intake 19 is located on the forward end of the housing 13, below chute 17. An impeller 21 is mounted in the housing on the forward end for drawing snow in through the intake 19 and discharging it through the chute 17. Impeller 21 is rotated through gears 23, driven by an electrical motor 25.

Figure 2:
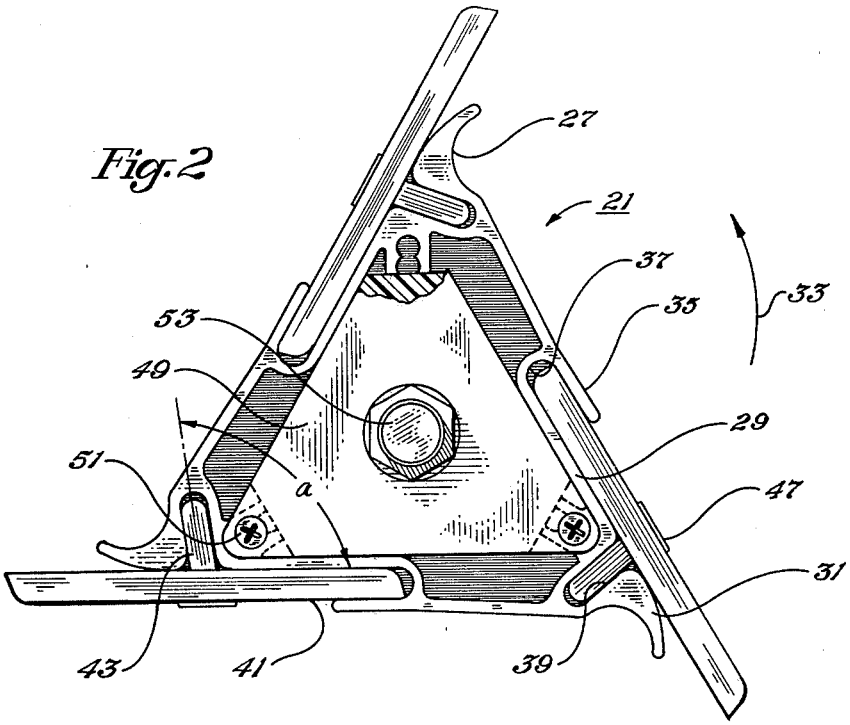
FIG. 2 is a view from one end of the impeller of FIG. 1, partially in section.

Referring to FIG. 2, the impeller 21 includes a rotor 27. Rotor 27 is a single piece member, generally triangular in transverse cross-section, as shown in FIG. 2, and extends the length of the impeller 21. Rotor 27 has three identical blade mounts formed integrally with the rotor.

Each blade mount has a blade supporting surface with an inner edge portion 29 and an outer edge portion 31. The inner edge portion 29 is located closer than the outer edge portion 31 to the rotational axis of rotor 27. The inner edge portion 29 is flat and lies in a plane that faces the direction of rotation, indicated by arrow 33. The outer edge portion 31 is curved rearwardly, considering the direction of rotation.

A retainer 35 extends over about half of the width of the inner edge portion 29. Retainer 35 extends the full length of the rotor 27 and comprises a flat member integrally formed with rotor 27. Retainer 35 is spaced forwardly of the inner edge portion 29 a selected distance, defining a channel 37.

A slot 39 is formed in the blade supporting surface, dividing the inner edge portion 29 from the outer edge portion 31. Slot 39 is formed in a plane that intersects the plane of the inner edge portion 29 at an obtuse angle a of about 110 degrees. The depth of slot 39 is about the same depth of channel 37. The width of slot 39 is about the same width as channel 37. Slot 39 extends the full length of rotor 27 parallel with the axis of rotation of the rotor. Slot 39 is located outward on the blade supporting surface from the entrance to channel 37.

A resiliently flexible blade 41 is adapted to fit in each blade mount. Blade 41 is of a rubberlike material, such as nylon, and has an inner edge portion that is adapted to fit tightly within channel 37. The outer edge portion of blade 41 extends beyond the curved outer edge 31. When in the nonrotating condition, blade 41 is a flat, planar strip. A flange 43 is formed integrally with blade 41 on its back surface equidistant from and parallel with the inner and outer edges. Flange 43 extends rearwardly perpendicular to blade 41 when detached from impeller 21. Flange 43 will bend with respect to blade 41 to fit tightly within slot 39. Flange 43 extends slightly less than the depth of slot 39.

Figure 3:
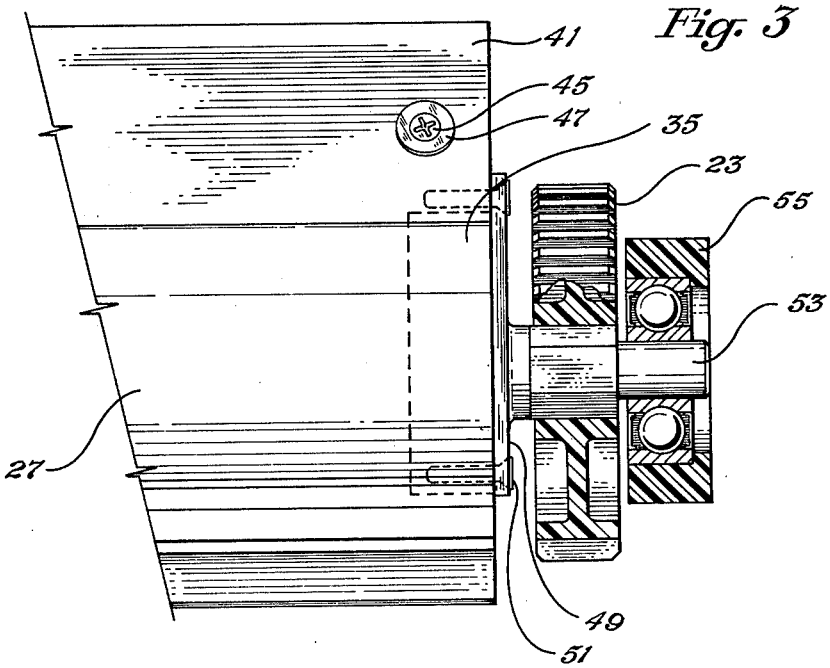
FIG. 3 is a partial front view, partially in section, of the impeller of FIG. 1.

If desired, a plurality of screws 45, as shown in FIG. 3, may be inserted through blade 41 and into rotor 27 to further retain the blades to the rotor. In the preferred embodiment, screws 45, encircled by a washer 47, are inserted at several points into the slot 39. Screws 45 are slightly greater in diameter than the width of slot 39. Slot 39 has been threaded at the various points to receive these screws 45.

Referring again to FIG. 2, a triangular rotor mount 49 is inserted into each end of rotor 27 and retained by screws 51. A shaft 53 extends outwardly from the center of each rotor mount 49, receiving one of the gears 23. Bearings 55 are mounted on the outer ends of shaft 53 for mounting the rotor to the housing 13, as shown in FIG. 1 and FIG. 3.

In operation motor 25 rotates gears 23 to rotate impeller 21. The impeller rotates the blade in the direction of arrow 33 (FIG. 2), drawing snow in through the intake 19 and throwing it out through chute 17. Referring to FIG. 2, the radial outward force due to the rotational motion is resisted by flange 43 in slot 39. Forces acting opposite to the direction of rotation due to the pressure exerted by the snow, are resisted by channel 37. Should it become necessary to replace blade 41 because of wear, screws 45 are removed, and the blades are pulled outward from rotor 27. The new blade is inserted into channel 37 and slot 39, then the screws 45 are replaced. Also, instead of replacing, the worn blade can be reused by inverting the blade. The worn outer edge is inserted into channel 37, and the former inner edge will serve as the outer edge.

The invention has significant advantages. The construction of the rotor is simple, yet provides means to retain the blades against rotational and radial forces. The blades are quickly removed and inserted in the rotor. It is not necessary that the rotor be removed from the housing, since the blades do not have to be inserted from the sides.

While the invention has been shown in only one of its forms, it should be apparent to those skilled in the art that it is not so limited, but is susceptible to various modifications without departing from the spirit of the invention.

I claim:

1. An impeller comprising:

a rotatably driven rigid rotor having an axis of rotation, the rotor having at least one blade mount with a blade supporting surface, the blade mount having a retainer that extends over a portion of the supporting surface to define a channel, the blade mount having a slot extending rearwardly from the supporting surface, the slot having inner and outer walls relative to the axis of rotation spaced apart from each other and having its greatest dimension in the direction parallel to the channel, the outer wall being located inward from the outer edge of the supporting surface, the inner wall being located outward from the channel; and a resilient flexible blade having an inner edge portion located in the channel, an outer edge portion protruding outward past the supporting surface, a back surface overlying the supporting surface, and a flange extending from the back surface into the slot.

2. In a snow thrower of the type having an impeller mounted within a housing that has an intake and a chute, and power means for rotating the impeller to draw snow in from the intake and discharge the snow through the chute, the impeller comprising:

a rigid rotor having at least one blade mount with a blade supporting surface extending the length of the rotor and facing generally the direction of rotation, the supporting surface having a planar inner edge portion and a curved outer edge portion, the blade mount having a retainer that extends over the inner edge portion, defining a channel between the retainer and the inner edge portion, the blade mount having a slot exterior of said channel and extending parallel with the axis of the rotor substantially the length of the blade mount; and a resiliently flexible blade having an inner edge portion located in the channel, an outer edge portion protruding past the supporting surface, and a flange extending rearwardly into the slot.

3. In a snow thrower of the type having an impeller mounted within a housing that has an intake and a chute, and power means for rotating the impeller to draw snow in through the intake and discharge the snow through the chute, the impeller comprising:

a single-piece rotor having an axis of rotation and being generally triangular in transverse cross-section, with three blade mounts formed integrally in the rotor, each blade mount having a blade supporting surface extending the length of the rotor and facing generally the direction of rotation, each supporting surface having a flat inner edge portion and an outer edge portion curved away from the direction of rotation, each blade mount having an integral retainer portion that extends over the inner edge portion to define a closed bottom channel between the inner edge portion and the retainer portion, each blade mount having a slot extending the length of the blade mount and located further outward from the axis of rotation than the retainer portion, the slot extending rearwardly from the supporting surface in a plane that intersects the plane of the inner edge portion at an obtuse angle; and a resiliently flexible blade having an inner edge portion located in the channel, an outer edge portion that protrudes past the supporting surface, a back surface that is planar in a nonrotating condition and overlies the supporting surface, and a flange extending the length of the blade rearwardly from the back surface into the slot, the flange being located in a plane transverse to the plane containing the back surface, the flange being located between inner and outer edges of the back surface.

* * * * *